United States Patent [19]

Baker

[11] 4,063,056

[45] Dec. 13, 1977

[54] BI-DIRECTIONAL LIMIT SWITCH

[75] Inventor: Robert K. Baker, Lemay, Mo.

[73] Assignee: Potter Electric Signal Co., St. Louis, Mo.

[21] Appl. No.: 706,749

[22] Filed: July 19, 1976

[51] Int. Cl.[2] ..... H01H 3/20

[52] U.S. Cl. ..... 200/332; 200/47; 200/153 T; 200/335

[58] Field of Search ..... 200/332, 335, 153 T, 200/47

[56] References Cited

U.S. PATENT DOCUMENTS

| | | | |
|---|---|---|---|
| 2,547,765 | 4/1951 | Lund | 200/335 |
| 3,252,345 | 5/1966 | Russell | 200/47 |

OTHER PUBLICATIONS

D Limit Switches Brochure Square D Co. 12/65.

*Primary Examiner*—Elliot A. Goldberg

[57] ABSTRACT

An electrical switch of the type actuated by depressing a spring-loaded plunger functions as a bi-directional limit switch. It utilizes a lever mechanism having two fulcrum points on opposite sides of the plunger. Deflection of the switch lever arm in either direction depresses the switch plunger.

8 Claims, 9 Drawing Figures

BI-DIRECTIONAL LIMIT SWITCH

BACKGROUND OF THE INVENTION

The present invention relates to electrical switches, primarily of the type known as limit switches. Such limit switches commonly utilize a spring-loaded plunger, whose end bears against a lever arm mounted on a fulcrum.

According to the best information of applicant, prior art limit switches operate by deflection of the lever arm in a single direction. If the purpose of the user is to sense deflection in two opposite directions, for example, to sense both high and low limits, two separate switches would be required.

It has been suggested in the prior art that the positioning of the lever and fulcrum by which a limit switch is operated may be varied so that, with the fulcrum on one side of the plunger, the operating arm will depress the plunger if deflected in one direction, whereas if the fulcrum be positioned on the opposite side of the plunger, the switch may be actuated by deflection of the operating arm in the opposite sense. Such a construction is shown in U.S. Pat. No. 2,547,765 to Lund.

SUMMARY OF THE INVENTION

The principal purpose of the present invention is to provide an improved limit switch capable of being actuated upon deflection of an operating lever arm in either of two directions, thus making it unnecessary to utilize two limit switches. A further purpose is to adapt the present invention to conventional types of limit switches, both those equipped with a fulcrum and operating arm and those which require an external fulcrum and operating arm system. Still further objects will be apparent from the disclosure which follows.

Summarizing the invention generally, without limiting its scope, the present improvement comprises the use of two fulcrum means, mounted on opposite sides of the plunger. Typically these fulcrum means may be pin members extending transversely to the axis of the plunger, spaced on opposite sides of it and positioned parallel to each other. On these fulcrum means is mounted lever means including an outstanding actuating arm. Normally the plunger holds the lever means in an undeflected position. As between the fulcrum means and the lever means there is together provided means which actuate the plunger by deflection of the operating arm means in either of two opposite directions.

In that type of switch equipped with a fulcrum and an operating arm mounted on a transverse pivot pin at the fulcrum, a second similar fulcrum at the opposite side of the plunger may be mounted in the same lugs which mount the first fulcrum. Convenient means are provided to permit both of the pivot pins to leave the fulcrum points against which they bear when the operating arm is rotated about the other. One such means is providing enlarged slotted holes in which the pivot pins are mounted and against whose outer ends they are normally held by the spring force of the plunger. When the lever arm is actuated in either sense, to depress the plunger by rotation about one of the bearing points against which one pin bears, the other will leave its bearing point and move in the slotted hole. Other provisions for freedom of movement of the lever arm from one of the fulcrum points, when pivoted about the other, are described in other of the embodiments which follow.

DESCRIPTION OF THE PREFERRED EMBODIMENT

Figure 1:
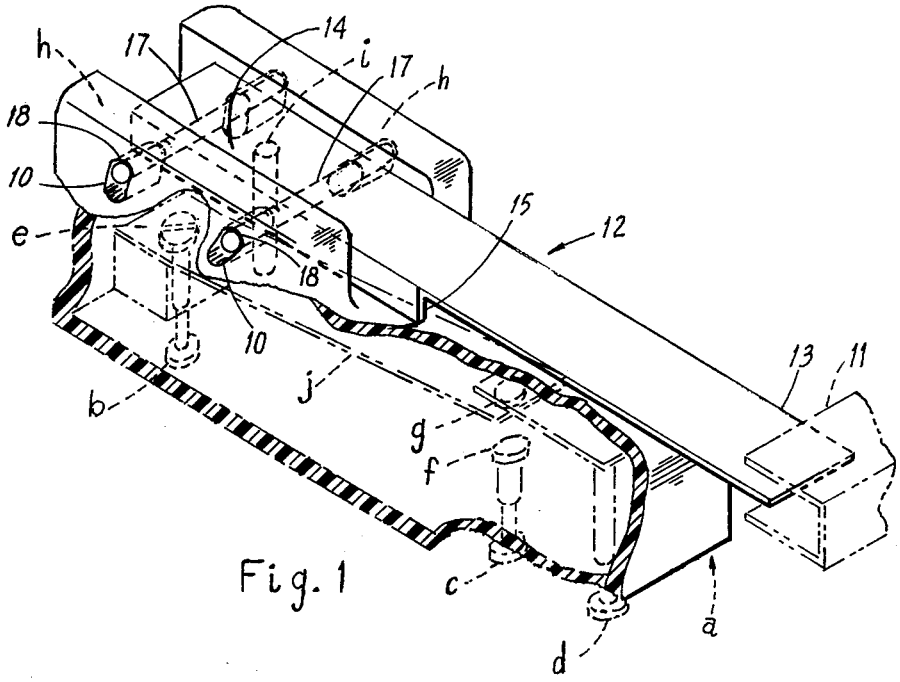
FIG. 1 is a perspective view partly broken away of a limit switch of the spring-urged plunger type which integrally incorporates a bi-directional lever mechanism. A channel bracket by which the actuating force may be applied to the lever arm is shown in phantom lines.
Figure 2:
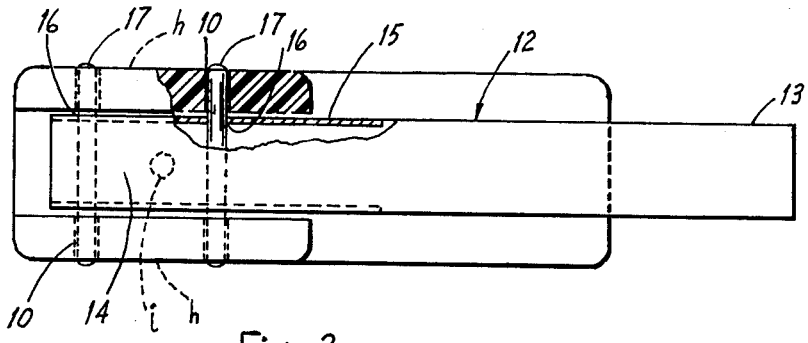
FIG. 2 is a plan view of the switch of FIG. 1, partly broken away.

A precision switch actuated by a spring-loaded plunger is shown somewhat schematically in FIG. 1. A molded plastic body generally designated *a* has external electrical contacts as follows: a commmon contact *b*, a normally open contact *c*, and a normally closed contact *d*. These three internal switch contacts, *b, c, d* are electrically connected to three internal switch contacts, *e, f, g* respectively. The longer sides of the switch body *a* have integrally formed lugs *h* which extend parallel to each other as shown in FIG. 2. Positioned mid-way between the lugs *h* as seen in this view is a switch plunger *i*, which protrudes outwardly through the switch body *a*, its inner end abutting a switch contact arm *j*. The switch contact arm *j* may be a leaf spring cantilever mounted at its left end to the common internal contact *e* and held in a normal position by a preload with its right end against the normally closed internal contact *g*. Depressing the plunger *i* rotates a right end of the switch contact arm *j* against the normally open contact *f* and away from the normally closed contact *g*.

In the preferred embodiment illustrated in FIGS. 1–4, each lug *h* has a first aperture 10, located on one side of the plunger *i*, and a similar second aperture 10, located on its opposite side. The embodiment also provides a lever arm generally designated 12 including a lever arm actuating portion 13 and a lever arm fulcrumed portion 14. Flanges 15 projecting toward the switch body *a* are provided, on the sides of the fulcrumed portion 14, with aligned bores 16 in which are mounted pins 17 which pass through the apertures 10. The spring load on the plunger *i* holds the lever arm fulcrumed portion 14 against the upper remote ends 18 of the apertures 10, which serve as fulcrum points.

The apertures 10 as shown in FIG. 1 are elongated slots whose upper remote ends 18, located in a plane substantially perpendicular to the axis of the plunger *i*, function as fulcrum points for the pins 17. Each aperture 10 extends downwardly toward the switch body *a* ideally along an arc formed about the upper remote end 18 of the other aperture 10. The slot portions of the apertures 10 are of sufficient width to permit the pins 17 to slide freely in them, and of a length which will permit their functioning in the manner set forth below.

Figure 3:
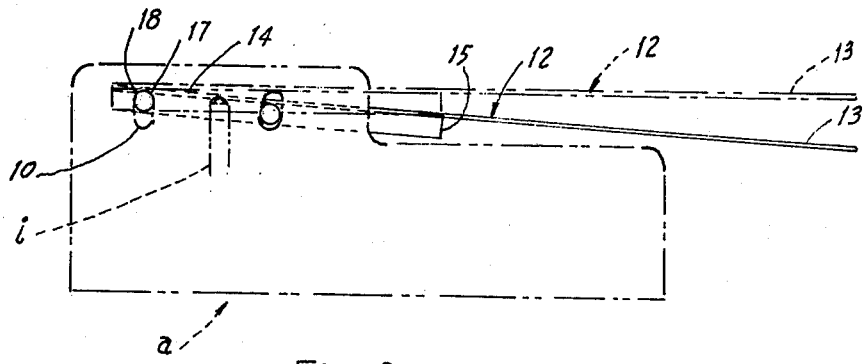
FIG. 3 is a schematic vertical section through a part of the switch of FIG. 1, with the actuating arm rotated about the left fulcrum and being free from the right fulcrum. The undeflected position is shown in phantom lines.
Figure 4:
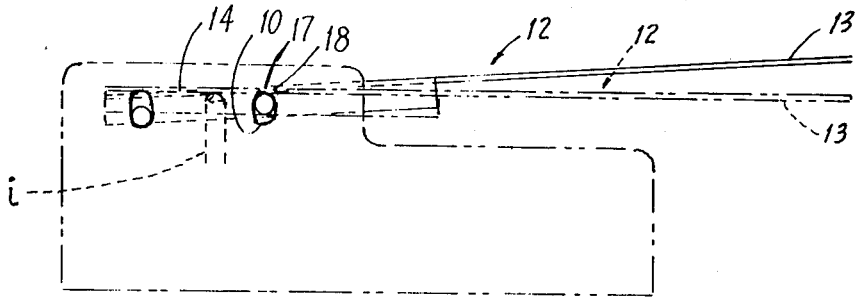
FIG. 4 is a schematic view similar to FIG. 3, showing the actuating arm deflected in the opposite sense about the right fulcrum and moved away from the left fulcrum.

As illustrated in FIGS. 3 and 4, deflection of the lever arm actuating portion 13 in either an upward or downward direction causes the lever arm 12 to pivot on one pin 17 about one upper remote end 18 of an aperture 10, sliding the other pin 17 downwardly in the other aperture 10. The plunger *i* is thereby depressed by the downward deflection of the lever arm fulcrumed portion 14. It may be noted that the apertures 10 could be of any shape which allows the pins 17 to slide freely in one aperture 10 while the upper end 18 of the other aperture 10 serves as a fulcrum point.

As shown schematically in FIG. 1, the lever arm actuating portion 13 may be actuated on contact with and further movement relative to either flange of a channel bracket 11. The bracket 11 is to be mounted on some part of apparatus whose movement relative to the switch body *a* is to be sensed. The bracket 11 is so positioned that its flanges are normally equidistant from the lever arm actuating portion 13 when undeflected.

Figure 5:
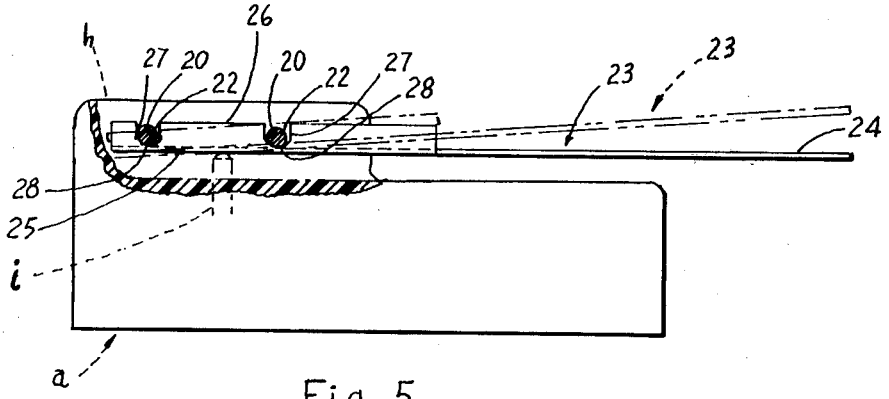
FIG. 5 is a side view, partly broken away, of a modified embodiment of the present invention in which the fulcrum pins remain in fixed position and the lever is mounted thereon in slots which permit it to leave one fulcrum pin when rotated about the other. The phantom lines illustrate the position of the lever when deflected in one sense.

An alternative embodiment of the present invention is illustrated in FIG. 5. In this embodiment the switch body and its interior components are substantially identical to those of the embodiments of FIG. 1 and the same letters are applied to the respective parts. The switch lugs *h* have provided in them two bores 20 aligned on a transverse axis located on one side of the plunger, and similarly two aligned bores 20 located on the opposite side of the plunger, all in a plane substantially perpendicular to the axis of the plunger. Through each pair of aligned bores 20 is fitted a fixed pin 22. A lever arm generally designated 23 has an actuating portion 24 and a fulcrumed portion 25, the latter having along each side a flange 26 projecting upward away from the switch body *a*. The flanges 26 have two pairs of aligned slots 27 engaging the pins 22. The slots 27, formed downwardly into the upper edges of the flanges 26 and terminating in lower bearing point ends 28, are sufficiently broad to permit free movement of the pins 22 in them. Optionally they might be arc-shaped in a similar manner to those of the first embodiment. The spring load on the plunger *i* serves to hold the lever arm 23 in a normal position upward, away from the switch body *a*, with the bearing point slot ends 28 pressed against the pins 22.

As will be clear from FIG. 5, deflection of the lever arm actuating portion 24 in either an upward or downward direction forces the lever arm 23 to pivot about a pin 22 fulcrumed at the bearing point ends 28 at one side of the switch plunger *i*, the other pair of bearing point ends 28 leaving the opposite pin 22 and swinging downward toward the switch body *a*. Since the center area of the lever arm fulcrumed portion will thus pivot downward toward the switch body *a*, it will depress and actuate the plunger *i*.

Figure 6:
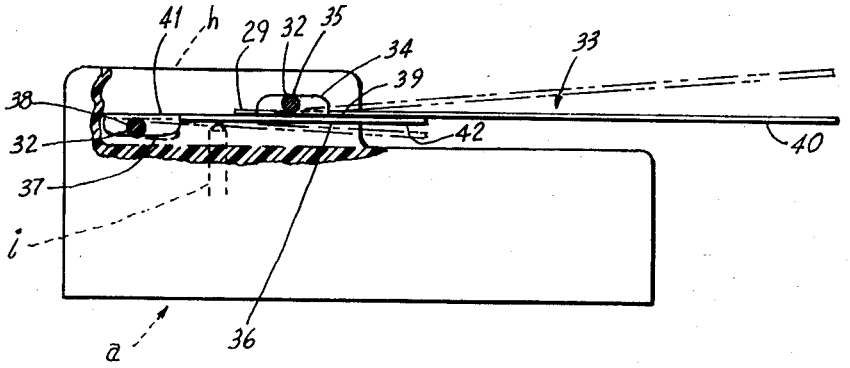
FIG. 6 is a view similar to FIG. 5 of another embodiment of the invention, in which the fulcrums on both sides of the plunger are fixed in their positions but supplemental lever means, pivoted about the right fulcrum, depresses the switch plunger on deflection in either direction. The phantom lines show the actuating arm deflected up.
Figure 7:
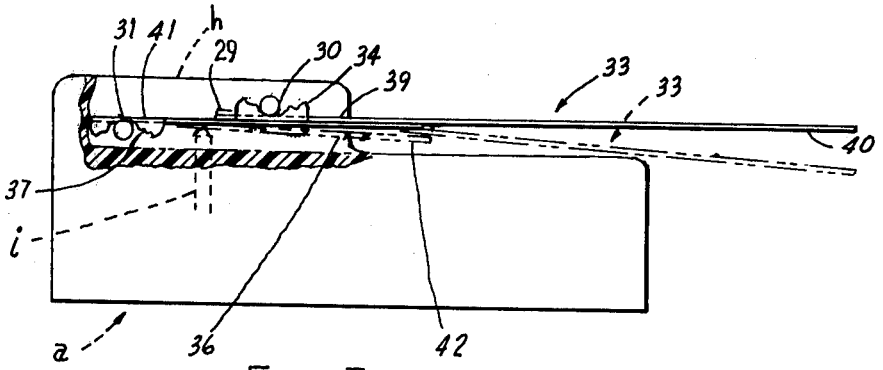
FIG. 7 is a schematic view of the embodiment of FIG. 6, its phantom lines showing the outstanding actuating arm deflected down.

A second alternative embodiment of the present invention is shown in FIGS. 6 and 7, in which the parts of the switch body *a* are substantially identical to the preferred embodiment of the switch body *a* shown in FIG. 1 with the following changes: the switch lugs *h* are fashioned with means for providing two aligned first lug bores 30 on the right end of each lug at a greater distance from switch body *a* than a second two aligned lug bores 31 which are located on the opposite side of the plunger *i*. Two pins 32 are mounted in the two pairs of aligned lug bores. A first lever arm 33, which serves as the driving lever, has flanges 34 on each side projecting upward away from the switch body with aligned flange bores 35, and is pivotally mounted into the first aligned lug bores 30 with a pin 32. A second lever arm 36, which serves as the driven lever, has flanges 37 on each side projecting downward toward the switch body *a*. These have aligned flanged bores 38, each pivotally mounted into the second aligned lug bores 31 with a pin 32. The first lever arm 33 has a fulcrumed portion 39, from which a principal actuating arm portion 40 extends beyond the right end of the switch body; and has a secondary actuating portion 29 on the left side of said fulcrumed portion 39. The second lever arm 36 has a fulcrumed portion 41 at the left and an actuating portion 42 extending to the right beyond the first aligned lug bores 30, held by said plunger *i* against the underside of the first lever arm fulcrumed portion 39 when the first lever arm actuating portion 40 is in an undeflected position.

Upward deflection of the first lever arm actuating portion 40, as shown in FIG. 6, rocks the secondary actuating portion 29 of the first lever arm 33 downward against the second lever arm actuating portion 42, to depress the plunger *i*. On downward deflection of the first lever arm actuating portion 40, as shown in FIG. 7, it presses against the right end of the second lever arm actuating portion 42, moving it downward, thereby pivoting the second lever arm 36 downward against the plunger *i*.

Figure 8:
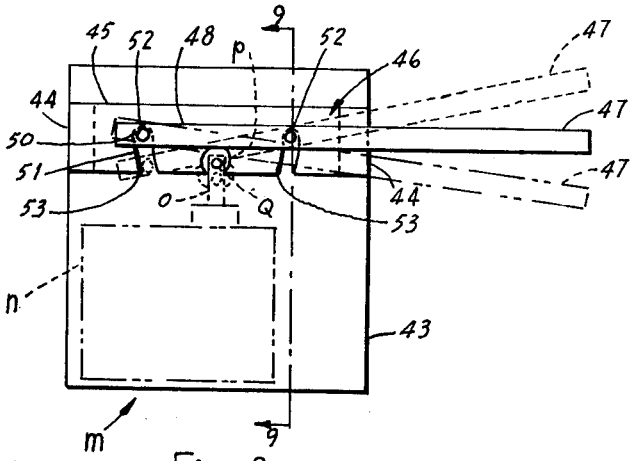
FIG. 8 is an elevational view of a lever mechanism embodying the present invention utilized in connection with a separate plunger-operated switch. The dashed lines show the position of the lever mechanism when rotated about the left fulcrum point; while the phantom lines show its position when rotated about the right fulcrum point.
Figure 9:
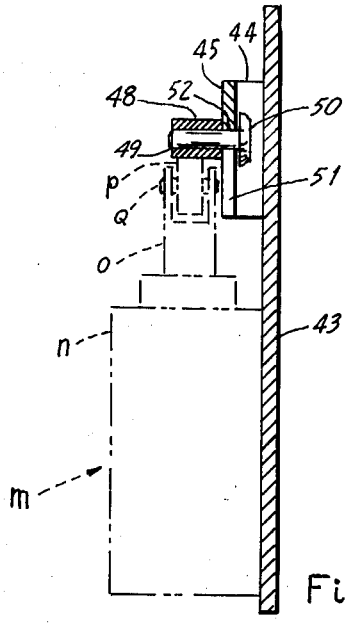
FIG. 9 is an enlarged fragmentary sectional view taken along line 9—9 of FIG. 8.

A third alternative embodiment of the present invention shown in FIG. 8 employs a type of switch which, as commercially available, has no lever arm to actuate its plunger. The switch *m* has a housing *n* incorporating switch elements corresponding in their function to those previously described. Its spring-loaded plunger *o* ends outwardly in a rolling fulcrum wheel *p* at its tip, held in place by a bearing pin *q*, as depicted in FIG. 9.

The switch housing *n* is conveniently mounted on a mounting plate 43. Two spacing blocks 44 are used to secure a fulcrum plate 45 to the mounting plate 43 above and to the inner side of the switch plunger *o*. A lever arm generally designated 46 has an actuating portion 47 and a fulcrumed portion 48, the latter having two bore holes 49 into which are fitted transverse pins 50 engaged in slots 51 in the fulcrum plate 45. The slots 51 are of sufficient width to accommodate the pins 50. They commence with slot openings 53 in that edge of the fulcrum plate 45 adjacent to the switch housing *n*, and extend upward and inward into the fulcrum plate 45 to rounded fulcrum bearing point ends 52 lying parallel to each other in a plane substantially perpendicular to the axis of the plunger. The slots 51 are so shaped that each describes an arc about the center of the bearing point end 52 of the other. The spring load on the plunger *o* holds the lever arm fulcrumed portion 48 in a normal position with both pins 50 pressed against the bearing point ends 52 of the slots 51.

A deflection of the lever arm actuating portion 47 in either direction will pivot the lever arm 46 about one bearing point end 52, the other pin 50 sliding in its slot 51. Such deflection causes its fulcrumed portion 48 to bear downward on the rolling fulcrum wheel *p* and depresses the plunger *o* in a manner analogous to the first embodiment.

It will ordinarily be desirable that the normal position of the switch be such that equal deflection of the lever arm actuating portion 47 in either direction will actuate the plunger *o*. From an examination of FIG. 8 it will be obvious that if the actuating portion 47 is not long compared to the distance between the left and right bearing point ends, this desired result can be achieved only if that fulcrum point which is to the right side of plunger *o* is closer to it than the fulcrum point on the left side of the plunger *o*. This principle is also applicable to the embodiments shown in FIGS. 1–5, but is less apparent in these because of the close spacing of the fulcrums compared to the length of the lever arms.

From this disclosure, modifications of detail of construction and application will suggest themselves to persons skilled in the art.

I claim:

1. In an electrical switch of the type actuated by a spring-loaded plunger extending outwardly along a reciprocating axis to an operating end, the improvement comprising two fulcrum means on opposite sides of the plunger, aligned parallel to each other and spaced from and transverse to the said axis of the plunger, and lever means, including an outstanding actuating arm portion, mounted operably on said fulcrum means and normally held by the spring-loaded plunger in an undeflected position, said fulcrum means and lever means together having means to actuate the plunger upon linear deflection of the said actuating arm portion in either of two opposite directions.

2. In an electrical switch of the type actuated by a spring-loaded plunger extending outwardly along a reciprocating axis to an operating end, the improvement comprising a single lever arm having an outstanding actuating arm portion and having a fulcrumed portion extending on opposite sides of and abutting the plunger, said lever arm being normally held by the spring-loaded plunger in an undeflected position, and being normally positioned substantially perpendicular to the reciprocating axis of the plunger, said lever arm being mounted on two fulcrum means each having a fulcrum point on opposite sides of the plunger, aligned parallel to each other and spaced from and transverse to the axis of the plunger, and means for permitting said lever arm to move from each of said fulcrum points when said lever arm is pivoted about the other.

3. The improvement as defined in claim 2, wherein said fulcrum point between the plunger and the lever actuating arm portion is positioned closer to the said plunger axis than is the other fulcrum point, whereby substatially equal deflections of the lever actuating arm portion in either of two directions will actuate the plunger.

4. The improvement as defined in claim 2, wherein the fulcrum points include bearing point ends, and wherein the means for permitting said lever arm to move from the fulcrum points include two slots in said fulcrum means, one located on each side of the plunger, commencing with said bearing point ends remote from the switch and being formed in an arc about the fulcrum bearing point end of the other slot, and wherein the fulcrum means further includes pin means mounted on said lever arm and slidably engaging the said slots.

5. The improvement as defined in claim 2, wherein the fulcrum means includes a pair of transverse pin means to mount said lever arm on said fulcrum points, and wherein the means for permitting said lever arm to move from the fulcrum points includes two apertures in said fulcrum means, said apertures being larger than said pin means and extending from said fulcrum points generally toward the switch, the extent of their enlargement toward the switch being sufficient to permit departure of each pin means from its fulcrum point incident to actuating the plunger by rotation about the other fulcrum point.

6. The improvement as defined in claim 2, wherein the fulcrum means includes a fixed transverse pin means located at each fulcrum point, and wherein the means for permitting said lever arm to move from the fulcrum points includes two slots in said lever arm, one on each side of the plunger, formed inwardly from that side of the lever arm, opposite to the plunger and terminating in bearing point ends at the fulcrum points, said slots being of sufficient breadth to permit the lever arm to depart from one of said pin means as it pivots about the other.

7. The improvement as defined in claim 1, wherein the fulcrum means on opposite sides of the plunger are fixed in position, and the lever means comprises two separate levers, one mounted on each said fulcrum means, the lever mounted on that fulcrum means between the plunger and the outstanding actuating arm portion being a driving lever including said actuating arm portion and having an inward portion extending toward the plunger and terminating short of said other fulcrum means in a secondary acutating end, and the lever mounted on the other said fulcrum being a driven lever extending from said other fulcrum, means against and across the plunger end and beneath said driving lever to an outer end beyond its fulcrum, whereby the said driving and driven levers so mounted on their fixed position fulcrum means serve as said means to actuate the plunger, the deflection of said outstanding actuating arm portion of the driving lever toward the switch depressing the outer end of said driven lever to drive down the driven lever, whereas deflection of said outstanding actuating arm portion of the driving lever away from the switch will cause its secondary actuating end to drive down the driven lever at a point between the two fulcrums.

8. A lever mechanism adapted for use with an electrical switch of the type actuated by a spring-loaded plunger extending outwardly along a reciprocating axis to an operating end, comprising a lever arm having an outstanding actuating portion and a fulcrumed portion extending on opposite sides of and abutting such switch plunger and normally positioned substantially perpendicular to the said axis of such plunger, two parallel fulcrums therefor, one located on each side of the plunger, against which the lever arm is normally held by the spring load of such plunger, said fulcrums having means for permitting said fulcrumed portion to move from either of said fulcrums when said lever arm is pivoted about the other said fulcrum, whereby deflection of said actuating portion in either direction will actuate the plunger.

* * * * *